US012276165B2

(12) United States Patent
Hitchcock et al.

(10) Patent No.: US 12,276,165 B2
(45) Date of Patent: Apr. 15, 2025

(54) LOST CIRCULATION EUTECTOID ALLOY DOWNHOLE DEPLOYMENT TOOL

(71) Applicant: SAUDI ARABIAN OIL COMPANY, Dhahran (SA)

(72) Inventors: Graham Richard Hitchcock, Aberdeenshire (GB); Arthur Hale, Angleton, TX (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 43 days.

(21) Appl. No.: 18/326,090

(22) Filed: May 31, 2023

(65) Prior Publication Data

US 2024/0401421 A1 Dec. 5, 2024

(51) Int. Cl.

| | |
|---|---|
| ***E21B 36/04*** | (2006.01) |
| ***E21B 10/42*** | (2006.01) |
| ***E21B 21/00*** | (2006.01) |
| ***E21B 33/138*** | (2006.01) |
| ***E21B 36/00*** | (2006.01) |

(52) U.S. Cl.

CPC ..... *E21B 21/003* (2013.01); *E21B 33/138* (2013.01); *E21B 36/00* (2013.01); *E21B 36/04* (2013.01); *E21B 10/42* (2013.01)

(58) Field of Classification Search

CPC ..... E21B 36/00; E21B 36/04; E21B 36/005; E21B 36/006; E21B 36/008; E21B 36/02; E21B 21/003; E21B 33/138

See application file for complete search history.

(56) References Cited

U.S. PATENT DOCUMENTS

| | | | | |
|---|---|---|---|---|
| 4,438,813 | A * | 3/1984 | Nikolaev | E21B 27/02 166/387 |
| 5,295,541 | A * | 3/1994 | Ng | C09K 8/502 166/295 |
| 6,523,610 | B1 * | 2/2003 | Griffith | E21B 43/10 166/57 |
| 10,597,970 | B2 | 3/2020 | Pipchuk et al. | |
| 11,536,111 | B2 | 12/2022 | Carragher et al. | |
| 12,037,870 | B1 * | 7/2024 | Hale | E21B 33/138 |
| 2002/0158064 | A1 * | 10/2002 | Spencer | E21B 33/138 166/60 |
| 2005/0109511 | A1 * | 5/2005 | Spencer | E21B 36/04 166/387 |
| 2006/0144591 | A1 * | 7/2006 | Gonzalez | E21B 29/10 166/57 |
| 2008/0047708 | A1 * | 2/2008 | Spencer | E21B 33/138 166/60 |

(Continued)

OTHER PUBLICATIONS

SLB Energy Glossary entry for "lost circulation", accessed Sep. 11, 2024 via https://glossary.slb.com/en/terms/l/lost_circulation.*

*Primary Examiner* — Blake Michener

(74) *Attorney, Agent, or Firm* — Osha Bergman Watanabe & Burton LLP

(57) ABSTRACT

A method repairing lost circulation conditions during drilling operations, including deploying a deployment tool to a lost circulation zone, charging the deployment tool with eutectic metal alloy pellets, activating a heater to melt the pellets through the deployment tool and out of the crucible onto the targeted zone to form a patch, removing the deployment tool, and milling away excess cooled and cured eutectic metal alloy.

14 Claims, 5 Drawing Sheets

(56) References Cited

U.S. PATENT DOCUMENTS

| | | | | |
|---|---|---|---|---|
| 2013/0087335 | A1* | 4/2013 | Carragher | E21B 36/00 166/57 |
| 2017/0145783 | A1* | 5/2017 | Davis | E21B 33/13 |
| 2017/0247971 | A1* | 8/2017 | Rivas Diaz | E21B 23/00 |
| 2020/0332620 | A1* | 10/2020 | Carragher | E21B 33/13 |
| 2021/0301605 | A1* | 9/2021 | Li | E21B 34/12 |

* cited by examiner

LOST CIRCULATION EUTECTOID ALLOY DOWNHOLE DEPLOYMENT TOOL

BACKGROUND

Lost circulation is a major issue associated with drilling wells, resulting in significant costs in repair and product loss. Lost circulation occurs when drilling fluid flows into one or more geological formations instead of returning up the annulus as the final product while drilling for oil. The drilling industry has developed several techniques to fight losses, including, for example, the use of lost-circulation materials (LCM) to plug fractures, the use of chemicals, the use of a lost circulation pill, and the use of cement. The pill is transported with a carrier fluid to the zone to seal the fracture and stop the loss of drilling fluid. The chemical methods and cementing are used in day-to-day drilling activities, but they are insufficient in some scenarios, especially in the case of total loss-of-circulation. In particular, as LCM or cement flows in the liquid phase to the loss zone, they end up drifting away deep into the fractures long before they solidify.

Currently, eutectic metal alloys are used for fracture repairs, as they melt at relatively low temperatures and solidify when cooled. These existing methods do not place the eutectic metal alloy accurately and close enough to a heat source for adequate melting at targeted locations. The existing methods for depositing eutectic metal alloys for repairs include the use of a carrier fluid, typically polymeric or bentonitic, and through a mechanical delivery system.

A heat source is necessary to melt the eutectic metal so that it can reach the desired location, and then the heating source is removed or deactivated to allow the eutectic metal alloy to cool and solidify to repair the fractures.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a deployment tool for repairing lost circulation conditions during drilling conditions, where the deployment tool contains eutectic metal alloy pellets, an area to charge these pellets, an area on the opposite end of the tool from charging where the pellets will be melted with an embedded heater, and a crucible on the end where the heater is located to deposit the melted eutectic alloy to the targeted location and cut away excess material.

In another aspect, embodiments disclosed herein relate to a method for using this deployment tool where the tool is deployed to a lost circulation zone and charged with eutectic metal alloy pellets. The heater in the deployment tool is activated while the drill string is continuously rotated and drilling fluid is pumped. The eutectic metal alloy pellets melt through the deployment tool toward the crucible that allows deposition on the targeted zone. The deployment tool is removed while monitoring drill string torque. The melted eutectic metal alloy cures over the targeted area into a patch and excess material is milled away using the blades on the crucible of the deployment tool.

Other aspects and advantages of the claimed subject matter will be apparent from the following description and the appended claims.

DETAILED DESCRIPTION

In one aspect, embodiments disclosed herein relate to a deployment tool and method for patching a section of a well using pellets made of a eutectic alloy, referred to herein as eutectic pellets. A eutectic alloy is a mixture of two or more components (most commonly alloys) in a ratio at which the mixture melts at a lower temperature than the melting point of any one of the individual components. Eutectic alloys will melt and solidify at the same, single temperature (rather than over a temperature range), which is sometimes referred to as the eutectic point. Examples of eutectic alloys include bismuth-based alloys, such as alloys of bismuth and tin, or alloys of bismuth and germanium and/or copper.

According to embodiments of the present disclosure, eutectic pellets may be used to patch a section of a well at a selected downhole location using a deployment tool. The deployment tool is charged with eutectic pellets. A charge ball may be utilized to push the eutectic pellets through the tool towards the crucible. While the deployment tool is rotating, a heating element is activated to melt the eutectic pellets, which causes eutectic alloy to melt through exit ports in the crucible to specific target zones. To initiate the process, a lost circulation zone must be identified and the deployment tool will be deployed to this lost circulation zone. A loss zone may refer to a portion of the well in which fluid being circulated through the well is partially or totally lost through the loss zone into the formation. Loss of circulation is physically seen when the flow rate in the returns line drops below the flow rate in lines leaving the mud pumps into the well. The difference between the two lines may be used to quantify the loss severity. Thus, there are degrees of loss of circulation that may be identified in a well. For example, a total loss of circulation occurs when no return fluid reaches the surface following introduction of drilling fluid into the wellbore. A partial loss of circulation occurs when a predefined minimum amount of return fluid reaches the surface following introduction of drilling fluid into the wellbore.

The use of eutectic metal alloy is aimed at higher loss rate circumstances rather than seepage and partial losses that can be resolved with existing, standard methods; however, the method of eutectic metal alloy will work on all loss scenarios. There are ranges of oil-based mud loss rate and water-based mud loss rates that indicate different categories of lost circulation, shown in units of billion barrels of petroleum liquids per hour, or bbl/h, as follows:

TABLE 1

Lost circulation based on oil-based mud and water-based mud loss rates.

| Category | Oil-Based Mud Loss Rate (bbl/h) | Water-Based Mud Loss Rate (bbl/h) |
|---|---|---|
| Seepage | <10 | <25 |
| Partial | 10 to 30 | 25 to 100 |
| Severe | >30 | >100 |
| Total | No Returns | No Returns |

Figure 2B:
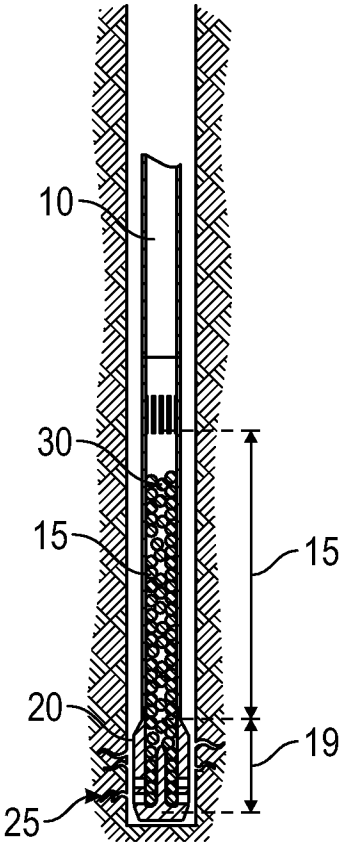
FIGS. 2A and 2B are illustrations of the deployment tool being charged with eutectic metal pellets according to one or more embodiments disclosed.
Figure 2A:
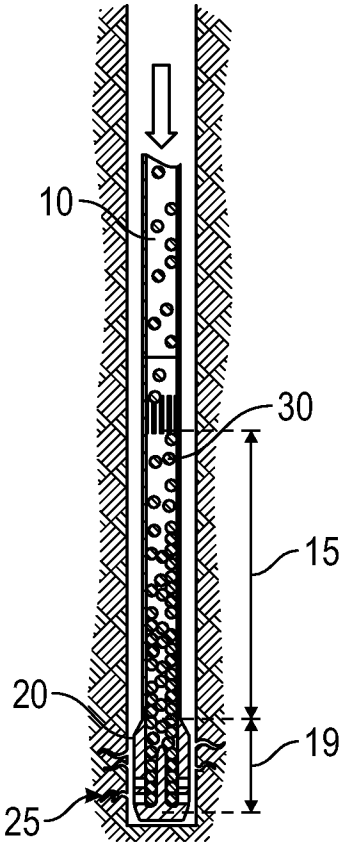
Figure 1:
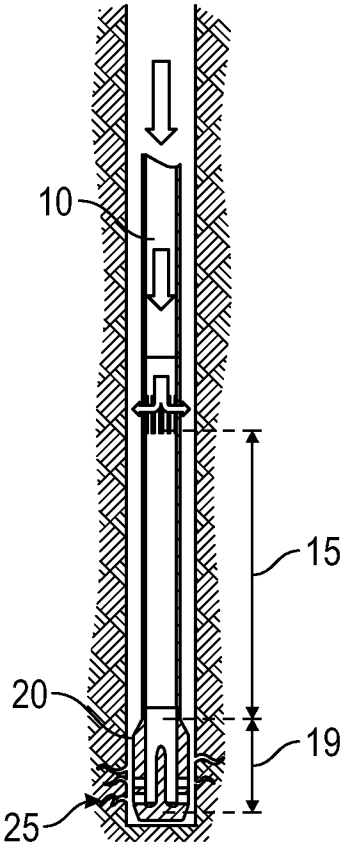
FIG. 1 is an illustration of a deployment tool for lost circulation according to one or more embodiments disclosed.

Once the lost circulation zone has been identified and the deployment tool has been installed and is ready for use, a plurality of eutectic pellets is charged into an alloy charge zone within the deployment tool from an above ground surface. Alternatively, the deployment tool can be pre-charged with eutectic pellets prior to installation into the formation. Referring to FIG. 1, the deployment tool initially is installed without eutectic pellets in the device. The tool has a drill pipe 10 through the center where the drilling fluid and the eutectic pellets will flow through. There is an identified alloy charge area 15 in the lower half of the tool leading into the crucible 20. The alloy melt area 19 is the area outside of the crucible where the melted eutectic pellets will flow into. The fractures 25 are present in the area around the crucible. Referring now to FIG. 2A, eutectic pellets 30 are shown being charged to the deployment tool. The charging may be accomplished by disposing the eutectic pellets 30 into a carrier fluid and pumping the carrier fluid through drill pipe 10. As seen in FIG. 2B, the eutectic pellets 30 will collect in the charge area 15 and be ready for deploying to the target zone.

Figure 4:
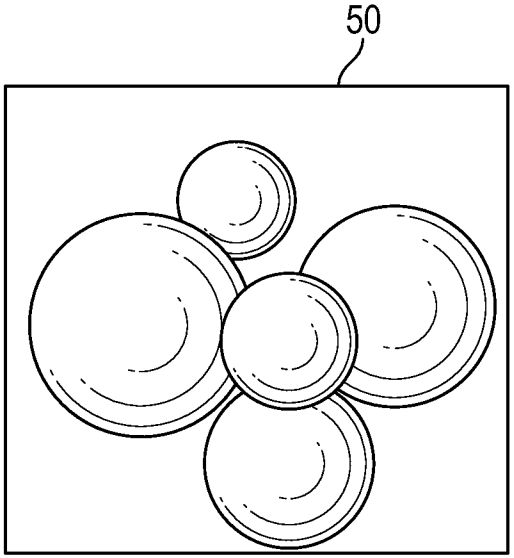
FIG. 4 is an illustration of typical drill string foam wiper ball according to one or more embodiments disclosed.
Figure 3B:
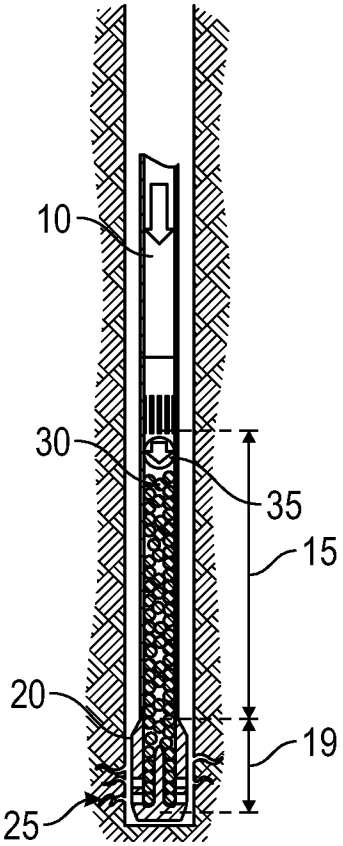
FIGS. 3A and 3B are illustrations of the deployment tool being charged with eutectic metal pellets and a charge ball according to one or more embodiments disclosed.
Figure 3A:
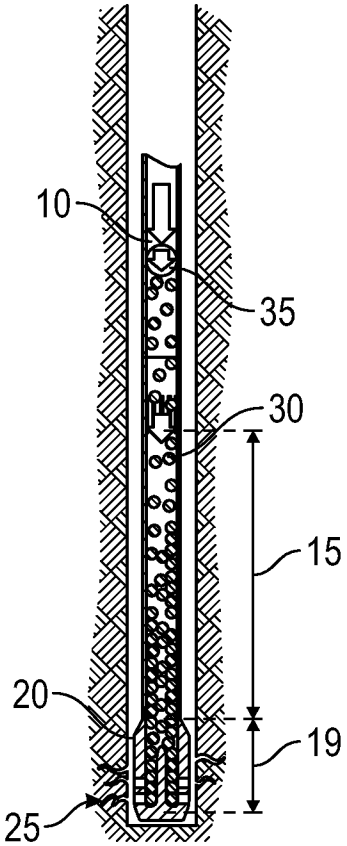

In embodiments where the eutectic pellets 30 do not easily flow to the charge area 15, a charge ball can be used to assist in guiding the eutectic pellets to the crucible. Referring to FIG. 3, the charge ball 35 is added into the drill pipe to exert downward pressure on the eutectic pellets 30 and move them downwards through the alloy charge area 15 and into the crucible 20. The charge ball 35 can be of many different types. FIG. 4 illustrates an example of the charge ball that is made similarly to a typical drill string foam wiper ball 50. Typically, a foam wiper ball is made from an elastomeric foam. In this process, the charge ball would be forced into the crucible once it has migrated down the drill pipe where it would deteriorate due to the heat and pass through the crucible jet ports. Multiple charge balls can be used throughout the process to ensure sufficient eutectic alloy has been deposited to address the loss zone. As with the eutectic pellets, the charge ball can be charged from an above ground surface or can be pre-charged in the deployment tool prior to installation into the formation.

By using assemblies and methods disclosed herein, where eutectic pellets are delivered to a selected downhole location in a deployment tool, the eutectic pellets may be held in the deployment tool, in the charge area, in the selected downhole location without getting lost into the surrounding formation (e.g., in a loss zone) prior to being melted into a eutectic patch. Thus, the deployment tool allows a volume of eutectic pellets to be accumulated in the selected downhole location in an amount capable of filling and patching the selected section of the well. After the eutectic pellets are accumulated in the deployment tool as a volume of eutectic pellets capable of filling and patching the selected section of the well, the volume of eutectic pellets may be melted together to form the eutectic patch.

As discussed above, the eutectic pellets may be made of a eutectic metal alloy. Additionally, eutectic pellets may have various shapes, including for example, generally spherical-shaped beads, irregular shaped pieces, or other shapes. Eutectic pellets may also have different sizes. For example, eutectic pellets may have an average diameter ranging from a lower limit selected from 1 mm, 2 mm, or 3 mm to an upper limit selected from 3 mm, 5 mm, 10 mm, or more, for example, depending on the manufacturing process used to make the pellets. For example, in some embodiments, eutectic pellets may be manufactured by pouring molten eutectic metal into a large quantity of water or other liquid, from which surface tension would then break the liquid metal into small spheres. Using such techniques, eutectic pellets may have an average diameter of between 2-3 mm. In embodiments using a basket with holes formed throughout the basket walls, the eutectic pellets may have an average diameter greater than an opening size of the basket holes. As such, the basket may be capable of containing the eutectic pellets while they are in pellet form (prior to melting the eutectic pellets).

The volume of eutectic pellets sent to the downhole location may be selected to fill a well section volume in the downhole location when melted. For example, prior to sending a volume of eutectic pellets to a downhole location, a well section volume in the downhole location may be estimated. A well section volume may be estimated, for example, by multiplying the cross-sectional area of the well at the downhole location (by the axial length of the well section in the downhole location being patched. Further, depending on the size and shape of the eutectic pellets being used, a volume of eutectic pellets (including the spaces between the pellets) may decrease to different molten eutectic material volumes when melted. Thus, selecting the volume of eutectic pellets to send downhole may also include estimating the volume reduction from melting the volume of eutectic pellets to form the molten eutectic material volume. According to embodiments of the present disclosure, a volume of eutectic pellets may be selected, for example, as an amount ranging from 1.5 to 2.5 times the estimated well section volume to be filled. A volume of eutectic pellets that results in an excess amount of eutectic material for the patch may be acceptable, as the excess volume may be milled away with a cutting tool on the crucible.

In some embodiments, estimation of a well section volume may further include adding a loss factor to account for additional well volume that may need filling to patch a loss zone. In such cases, the estimated volume of eutectic pellets may be increased by a loss factor proportional to an estimated size of the loss zone. For example, the size of a loss zone may be estimated based on an estimated opening area (the area of the opening to the loss zone fracture(s)), and the loss factor may be selected as being, for example, 1 to 1.5 times the estimated size of the loss zone. For example, in some embodiments, the size of a loss zone may be estimated from the amount of loss detected at the surface of the well. In one or more embodiments, an estimated volume of eutectic pellets may be estimated based on a "modified" diameter of the wellbore location being patched, where the modified diameter may be modified by an estimated depth of penetration into the formation. For example, an estimated penetration of a few inches into the formation may result in a modified diameter of the wellbore diameter plus a few inches. By accounting for a loss factor in the volume of eutectic pellets sent to a downhole location, the volume of eutectic pellets may be designed to have enough eutectic material to flow partially into the loss zone when melted. As the molten eutectic alloy flows into the loss zone, the eutectic alloy cools. Once the molten eutectic alloy cools to its eutectic temperature, the eutectic alloy resolidifies to seal the loss zone.

Figure 5C:
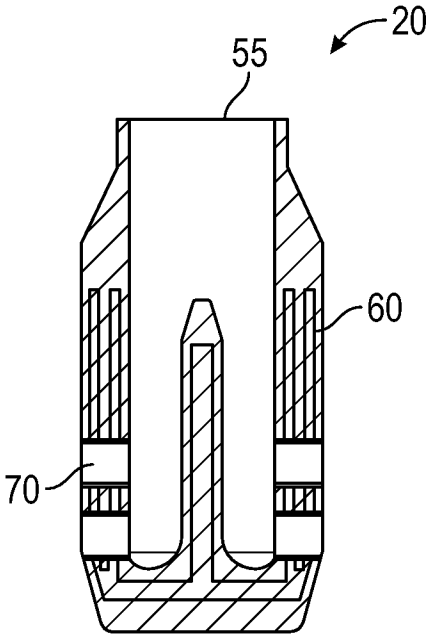
FIG. 5C is an illustration of the crucible of the deployment tool with its heating elements and jet ports visible according to one or more embodiments disclosed.
Figure 5B:
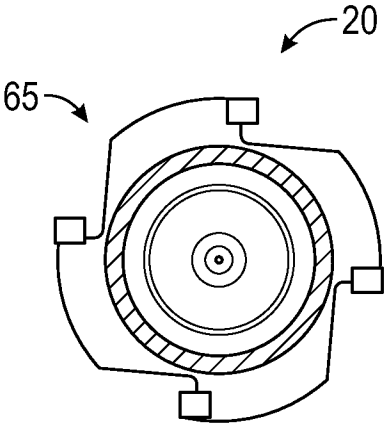
FIG. 5B is an illustration of a cross section of the crucible showing the cutting blades of the deployment tool according to one or more embodiments disclosed.
Figure 5A:
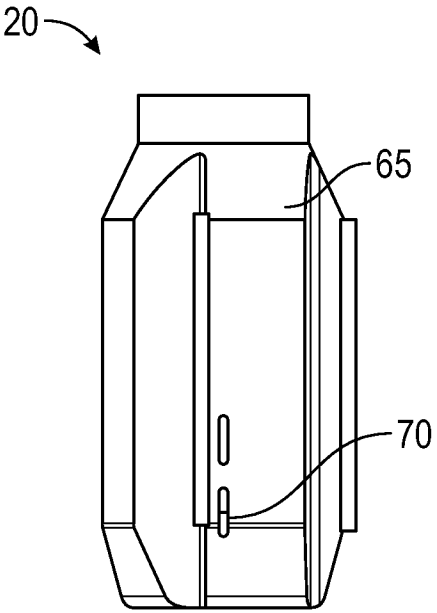
FIG. 5A is an illustration of the crucible of the deployment tool according to one or more embodiments disclosed.
Figure 6:
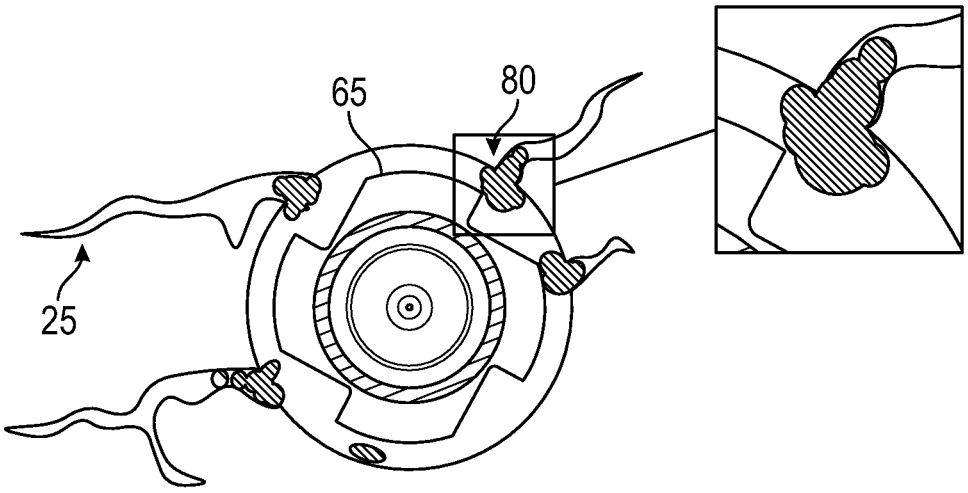
FIG. 6 is an illustration of the cutting blades of the crucible of the deployment tool according to one or more embodiments disclosed.

Once the alloy charge area has been charged with eutectic pellets, with or without the use of a charge ball, a deployment tool is activated. Referring to FIG. 5A, the crucible is shown with the cutting blades 65 and the crucible jet ports 70. During this portion of the process, the deployment tool will be continually rotating to allow for the cutting blades, shown in a below view in FIG. 5B to function and to encourage even distribution of the eutectic metal alloy deposition. The cutting blades serve multiple purposes including ensuring minimum gauge well bore diameter and cutting the buildup of excessive solidified eutectic alloy from the wellbore. Referring to FIG. 5C, the heating elements 60 are embedded into the elements and the crucible is attached to the deployment tool at an interface 55. Referring to FIG. 6, the cutting blades 65 are shown cutting the eutectic alloy patches 80 within the fractures 25. The cutting blades may be made of any insert-type cutting element, including tungsten carbide, ceramic, tool steel, and polycrystalline diamond compact (PDC), and combinations thereof. The cutting blades will be either mechanically fixed to the crucible body with a fastener or bonded using a polymeric bonding agent. Examples of fasteners that can be used are screws, bolts, and rivets. The rate of rotation is based on the diameter of the tool and the wellbore. Larger diameters of these parameters correlate to higher necessary rates of rotation to adequately push into the formation.

During this portion of the process, the drilling fluid is also being pumped through the drill pipe to maintain a hydrostatic pressure in the column of drilling fluid and assist in carrying the eutectic metal alloy downhole. By continuing fluid flow during treatment, the effectiveness of the process can be assessed in real time. The pumping flow rate is directly related to the diameter of the tool and the wellbore. Larger diameters require a higher flow rate and pumping pressure.

Figure 7C:
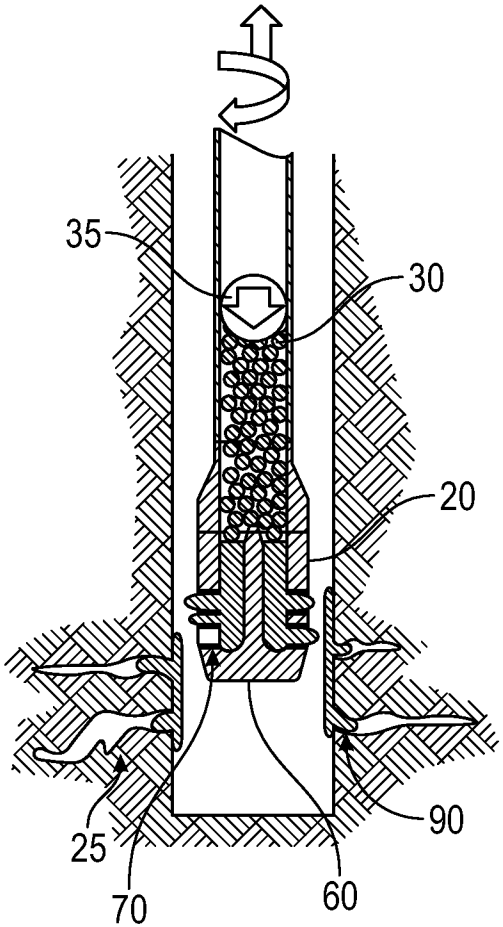
FIG. 7C is an illustration of the deployment tool rotating as eutectic metal pellets are melted and exit the crucible according to one or more embodiments disclosed.
Figure 7B:
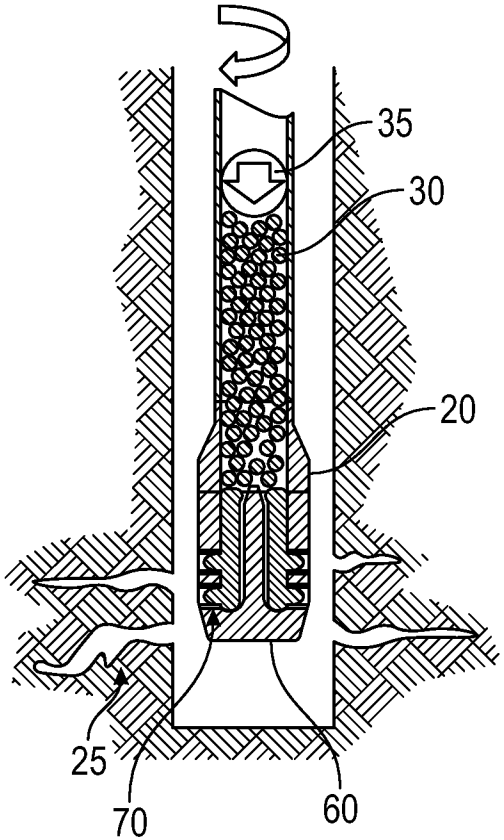
FIG. 7B is an illustration of the deployment tool rotating as eutectic metal pellets are melted and begin filling the crucible according to one or more embodiments disclosed.
Figure 7A:
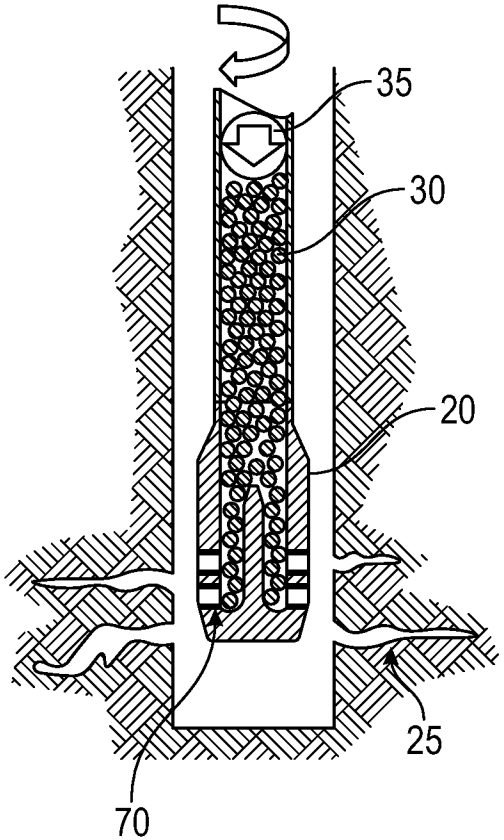
FIG. 7A is an illustration of the deployment tool rotating as eutectic metal pellets are charged according to one or more embodiments disclosed.

The embedded heat elements allow for direct, targeted heating of the eutectic metal alloy. Referring to FIG. 7A, initially the deployment tool is rotating with a fully charged alloy charge area without heat applied. In some embodiments, the deployment tool may be heated before rotation and cutting begin, allowing melting to begin before rotation and cutting. In other embodiments, the heating, rotation and cutting, and melting may occur simultaneously. Referring to FIG. 7B, the heat elements 60 are activated in the crucible to begin to melt the eutectic pellets, while rotation continues. Referring to FIG. 7C, the melted eutectic pellets exit the crucible through the crucible jet ports 70 and fill in the fractures 25 in the lost circulation zone. Once the eutectic metal alloy reaches the lost circulation zones, due to the eutectic metal alloy properties, the eutectic metal alloy solidifies to form a patch 90 directly over and within the walls of the fracture.

According to embodiments of the present disclosure, after a eutectic patch is formed in a well, the eutectic patch may be milled to trim excess material and allow well drilling to continue. For example, a eutectic patch may be used to seal lost circulation zones around the well wall to allow for effective continued drilling. Once the eutectic patch has solidified and been milled through as needed, the deployment tool is extracted, while continually rotating and monitoring drill string torque. Throughout the process, the volume of drilling fluid in and the volume of drilling fluid out of the well should be continually monitored.

Various types of heaters may be envisioned for use in a deployment tool according to embodiments of the present disclosure, where the heater may include an electrical connection for electrically activating the heater (e.g., via a wireline connection to a power source at the surface of the well). The heater is embedded into the deployment tool, either in the main body of the tool or in the crucible. The heater may be made up of multiple heating elements or a single heating element. The heater is generally a resistance-type heating element. An example of a useful heater in this application includes a mineral insulated heater, as these are made of robust materials and allow for precise placement and temperature control.

According to embodiments of the present disclosure, after a selected volume of eutectic pellets are delivered into a deployment tool assembly, the heater in the deployment tool may be connected to a power source at the surface of the well via a wireline. In alternative embodiments, a heater in a deployment tool may be connected to a downhole power source (e.g., located at an end of the pipe string carrying the deployment tool) and triggered through a timer. In some embodiments, a heater in a deployment tool may be connected to a downhole power source and triggered by communication through pressure pulses.

The deployment tool is withdrawn from the hole once the eutectic alloy has been deposited into the lost circulation zone and milling of the eutectic patch has completed. Several parameters are used to dictate the rate of tool removal. These parameters include heater temperature, eutectic metal alloy temperature, rock temperature, drilling fluid back pressure, and rate of loss of fluid into the formation. Rock temperature means the temperature differential between the initial, pre-process temperature and the temperature following eutectic metal alloy deposition. Drilling fluid back pressure means the charge ball pressure. A high rate of fluid loss may suggest that fractures need additional eutectic alloy into the formation and the process may be repeated.

Advantageously, by using a deployment tool according to embodiments of the present disclosure to form a eutectic patch in a downhole location of a well, the eutectic material may be delivered to the downhole location without being lost in the well. Additionally, by delivering the eutectic material to the downhole location in the form of pellets around a heater in the deployment tool, the eutectic material may be more easily melted into molten eutectic alloy to fill the downhole location. The molten eutectic alloy may then cool to resolidify and form a eutectic patch. Advantageously, eutectic alloys expand upon resolidifying, which may act as a better patch when compared with other non-eutectic metals that shrink upon resolidifying. Currently, eutectic metal applications generally use carrier fluids, which can be inaccurate in targeting specified locations.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. An apparatus for repairing lost circulation conditions during drilling operations, comprising:

a deployment tool, comprising:

a pellet form of eutectic metal alloy;

an alloy charge area proximate an upper end of the deployment tool;

an alloy melt area proximate a lower end of the deployment tool;

one or more embedded heating elements; and a drill string mounted crucible located in the alloy melt area, comprising:

a plurality of crucible jet ports; and a plurality of cutting blades.

2. The apparatus of claim 1, further comprising a charge ball made of foam to guide the eutectic pellets to the crucible.

3. The apparatus of claim 1, wherein the one or more heating elements may be a mineral insulated heater.

4. The apparatus of claim 1, wherein the cutting blades are adhered to the crucible either mechanically using a fastener or chemically using a polymeric binding agent.

5. The apparatus of claim 4, wherein the cutting blades are constructed of an insert-type cutting element including tungsten carbide, ceramic, tool steel, polycrystalline diamond compact, or combinations thereof.

6. The apparatus of claim 1, wherein the crucible is constructed of a phenolic or epoxy based composite resin.

7. A method for repairing lost circulation conditions during drilling operations comprising:

deploying a deployment tool attached to a drill string to a lost circulation zone;

charging an alloy charge area with a plurality of eutectic pellets;

activating a deployment tool heater while continuously rotating the drill string and pumping a drilling fluid;

melting the eutectic pellets in the deployment tool attached to the drill string to flow melted eutectic metal alloy through a plurality of crucible jet ports to a targeted location in the lost circulation zone;

removing the deployment tool while simultaneously monitoring drill string torque; and milling excess material from a plurality of eutectic patches formed from cured eutectic metal alloy.

8. The method of claim 7, further comprising pre-charging the eutectic pellets in the alloy charge area prior to running the deployment tool attached to the drill string to the loss zone.

9. The method of claim 7, wherein charging the alloy charge area with the plurality of eutectic pellets further comprises deploying eutectic pellets from an above ground surface once the deployment tool and the drill string are deployed to the lost circulation zone.

10. The method of claim 7, wherein charging the alloy charge area with the plurality of eutectic pellets further comprises using a charge ball to assist in transporting the eutectic pellets through the deployment tool and a drill pipe of the drill string by placing a downward pressure on the pellets.

11. The method of claim 7, wherein the targeted location is a location with a fracture contributing to lost circulation conditions.

12. The method of claim 7, further comprising determining if the deployment tool should be redeployed into the lost circulation zone, wherein the determining comprises:

circulating a drilling mud in a well comprising the lost circulation zone;

monitoring a flow rate of the drilling mud through a first mud line running from a mud pump to the well comprising the lost circulation zone; and monitoring a flow rate of a fluid return line from the well.

13. The method of claim 12, wherein, when the flow rate of the drilling mud through the first mud line is greater than the flow rate of the fluid return line, the deployment tool is redeployed into the lost circulation zone.

14. The method of claim 12, wherein, when the flow rate of the drilling mud through the first mud line is less than or equal to the flow rate of the fluid return line, the deployment tool is removed from the well.

* * * * *